US005909792A

United States Patent [19]

Gerlier et al.

[11] Patent Number: 5,909,792

[45] **Date of Patent: *Jun. 8, 1999**

[54] BANKNOTE READER

[75] Inventors: André Gerlier, Sciez, France; Roberto Polidoro; Guillermo Garcia, both of Geneva, Switzerland

[73] Assignee: Mars Incorporated, McLean, Va.

[ * ] Notice: This patent is subject to a terminal disclaimer.

[21] Appl. No.: 08/891,147

[22] Filed: Jul. 10, 1997

Related U.S. Application Data

[62] Continuation of application No. 08/551,930, Oct. 23, 1995, Pat. No. 5,662,201, which is a continuation of application No. 08/162,140, filed as application No. PCT/CH93/00095, Apr. 14, 1993, abandoned.

[30] Foreign Application Priority Data

Apr. 16, 1992 [CH] Switzerland ..... 1271/92-2

[51] Int. Cl.[6] ..... G07D 7/00

[52] U.S. Cl. ..... 194/206

[58] Field of Search ..... 194/206, 207; 209/534; 186/37; 271/180, 181

[56] References Cited

U.S. PATENT DOCUMENTS

| | | |
|---|---|---|
| 2,278,188 | 3/1942 | Bamford et al. . |
| 3,026,023 | 3/1962 | Hirschfeld . |

(List continued on next page.)

FOREIGN PATENT DOCUMENTS

| | | |
|---|---|---|
| 1 310 023 | 10/1992 | Canada . |
| 0 131 812 | 1/1985 | European Pat. Off. . |
| 0 148 310 | 7/1985 | European Pat. Off. . |
| 0 174 009 | 3/1986 | European Pat. Off. . |
| 0 194 139 | 9/1986 | European Pat. Off. . |
| 0 395 047 A2 | 10/1990 | European Pat. Off. . |
| 0 395 047 A3 | 10/1990 | European Pat. Off. . |
| 1 271 264 | 7/1960 | France . |
| 2 453 811 | 11/1980 | France . |
| 2 545 462 | 11/1984 | France . |
| 2 621 305 | 4/1989 | France . |
| 1 942 845 | 3/1970 | Germany . |
| 2 028 649 | 12/1971 | Germany . |
| 2 064 724 | 7/1972 | Germany . |
| 2 157 379 | 5/1973 | Germany . |
| 2 336 335 | 12/1974 | Germany . |
| 2 431 569 | 2/1975 | Germany . |
| 2 408 584 | 8/1975 | Germany . |
| 2 619 620 | 1/1977 | Germany . |
| 2 760 165 C2 | 12/1979 | Germany . |
| 3 830 339 | 3/1989 | Germany . |
| 407 178 | 8/1966 | Switzerland . |
| 558 575 | 1/1975 | Switzerland . |
| A 658 736 | 11/1986 | Switzerland . |
| A 661 603 | 7/1987 | Switzerland . |

(List continued on next page.)

OTHER PUBLICATIONS

Landis & Gyr brochure entitled "Systeme de Traitment de Billets de Banq BSN 385/39/35" Published Sep. 1991.

*Primary Examiner*—F. J. Bartuska
*Attorney, Agent, or Firm*—Fish & Richardson P.C.

[57] ABSTRACT

A banknote reader for initiating a service operation of a vending machine (6) comprises an installation housing of side plates (1) and a money container (11). An interior (14) between the side plates (1) has devices (15; 16; 18; 19; 21; 22; 24) for aligning, transporting, checking and rejecting banknotes (8) and are arranged as modules at predetermined locations along the transport path of the banknotes (8). The installation housing has exchangeable front parts (2; 3; 24) and has on opposite narrow sides (9; 12) a flap 13, which can be pivoted for maintenance work and contains a built-in control device (25), and a connecting opening (10) to the money container (11), respectively. A minimal design of the banknote reader comprises at least a transport system (15), an entry channel (16) for aligning the banknotes (8), a drive unit (22) of the transport system (15), a checking device (18) for recognising genuine banknotes (8), and the control device (25).

3 Claims, 7 Drawing Sheets

U.S. PATENT DOCUMENTS

| | | | |
|---|---|---|---|
| 3,064,785 | 11/1962 | Weingart . | |
| 3,083,012 | 3/1963 | Poland . | |
| 3,108,694 | 10/1963 | Crain et al. . | |
| 3,162,439 | 12/1964 | Poland et al. . | |
| 3,222,057 | 12/1965 | Couri . | |
| 3,265,205 | 8/1966 | Chumley . | |
| 3,272,044 | 9/1966 | Obenshain . | |
| 3,426,879 | 2/1969 | Walker . | |
| 3,447,655 | 6/1969 | Tanaka et al. . | |
| 3,481,464 | 12/1969 | Townsend . | |
| 3,614,087 | 10/1971 | Zernov . | |
| 3,632,105 | 1/1972 | Verhoeven . | |
| 3,683,943 | 8/1972 | De Crepy . | |
| 3,888,267 | 6/1975 | Gautschi . | |
| 3,917,260 | 11/1975 | Okkonen et al. | 271/181 |
| 3,935,933 | 2/1976 | Tanaka et al. . | |
| 4,168,058 | 9/1979 | Granzow et al. . | |
| 4,193,685 | 3/1980 | Rudy et al. . | |
| 4,363,584 | 12/1982 | Kokubo . | |
| 4,441,701 | 4/1984 | Beentjes et al. . | |
| 4,462,509 | 7/1984 | Adelberger . | |
| 4,468,021 | 8/1984 | Weber . | |
| 4,479,049 | 10/1984 | Hirose | 194/206 X |
| 4,482,057 | 11/1984 | Shawn et al. | 209/534 |
| 4,540,081 | 9/1985 | Mori et al. | 194/207 |
| 4,552,350 | 11/1985 | Naby et al. . | |
| 4,557,352 | 12/1985 | Tschappat | 186/37 |
| 4,578,009 | 3/1986 | Granzow et al. . | |
| 4,585,144 | 4/1986 | Granzow et al. . | |
| 4,624,359 | 11/1986 | Gross . | |
| 4,697,944 | 10/1987 | Peebles et al. . | |
| 4,699,374 | 10/1987 | Hain . | |
| 4,747,493 | 5/1988 | Nakanishi | 209/534 |
| 4,807,736 | 2/1989 | Kondo et al. | 194/206 |
| 4,822,018 | 4/1989 | Hain . | |
| 4,858,744 | 8/1989 | Dolejs et al. | 194/206 |
| 4,871,085 | 10/1989 | Graef et al. | 221/4 |
| 4,880,096 | 11/1989 | Kobayashi et al. | 194/206 |
| 4,922,109 | 5/1990 | Bercovitz et al. | 250/556 |
| 5,064,074 | 11/1991 | Edin et al. . | |
| 5,156,250 | 10/1992 | Parish et al. | 194/348 |
| 5,222,584 | 6/1993 | Zouzoulas | 194/207 |

FOREIGN PATENT DOCUMENTS

| | | |
|---|---|---|
| 1 510 934 | 5/1978 | United Kingdom . |
| 2 054 534 | 2/1981 | United Kingdom . |
| 2 110 188 | 6/1983 | United Kingdom . |
| 2 142 320 | 1/1985 | United Kingdom . |
| A 2 197 300 | 5/1988 | United Kingdom . |
| 2 209 518 | 5/1989 | United Kingdom . |

BANKNOTE READER

This is a continuation application of application Ser. No. 08/551,930 filed on Oct. 23, 1995, now U.S. Pat. No. 5,662,201, which is a continuation of application Ser. No. 08/162,140 filed Dec. 14, 1993 as PCT/CH93/00095, Apr. 14, 1993 now abandoned.

FIELD OF THE INVENTION

The invention relates to a banknote reader of the type having an entrance aperture, an entrance channel, validating means and drive means for driving a banknote, which has been inserted through the aperture, along the channel to the validating means.

Such banknote readers are suitable, for example, for initiating a service in vending machines by means of predetermined denominations of banknote.

A banknote reader of that kind is known from FR-A 2 453 811 in which an entry barrier upstream of a banknote checking device prevents further banknotes from being inserted too quickly before the checking device has checked the authenticity of the banknote and stacked or rejected the banknote.

BACKGROUND OF THE INVENTION

U.S. Pat. No. 4,807,736 and U.S. Pat. No. 4,858,744 describe compact banknote reading devices for installation in vending machines, which are housed together with a banknote container in a space-saving manner in the same frame.

It is also known (DE-OS 20 28 649 and DE-PS 29 19 620) to arrange downstream of the checking device a temporary store for the banknotes recognised and accepted by the checking device. With a banknote reader of this kind an instruction can be implemented only when the amount required for the service, which is composed, for example, of several banknotes, is already in the temporary store.

CH-PS 661 603 and the patent specifications mentioned above disclose the arrangement of checking devices that scan the banknotes using an optical or magnetic process, and means for transporting the banknotes. The banknotes are stacked in, for example, money cassettes known from CH-PS 658 736, which are secured against theft of the banknotes. A stacking device is disclosed in Research Disclosure, December 1984, RD 24820.

The devices described in those patent specifications have the disadvantage that each of the designs described is tailored to the needs of a specific customer, requires a relatively large amount of space and does not permit simple changes to the construction.

The problem underlying the invention is to provide an inexpensive banknote reader that does not have those disadvantages but can easily be adapted to customer-specific requirements and is maintenance-friendly.

The invention provides a banknote handling device wherein one or more components are readily exchangeable modules so as to facilitate mounting of the device in multiple orientations.

SUMMARY OF THE INVENTION

Illustrative embodiments of the invention are described in detail below with reference to the drawings, in which:

DETAILED DESCRIPTION OF THE DRAWINGS

Figure 1:
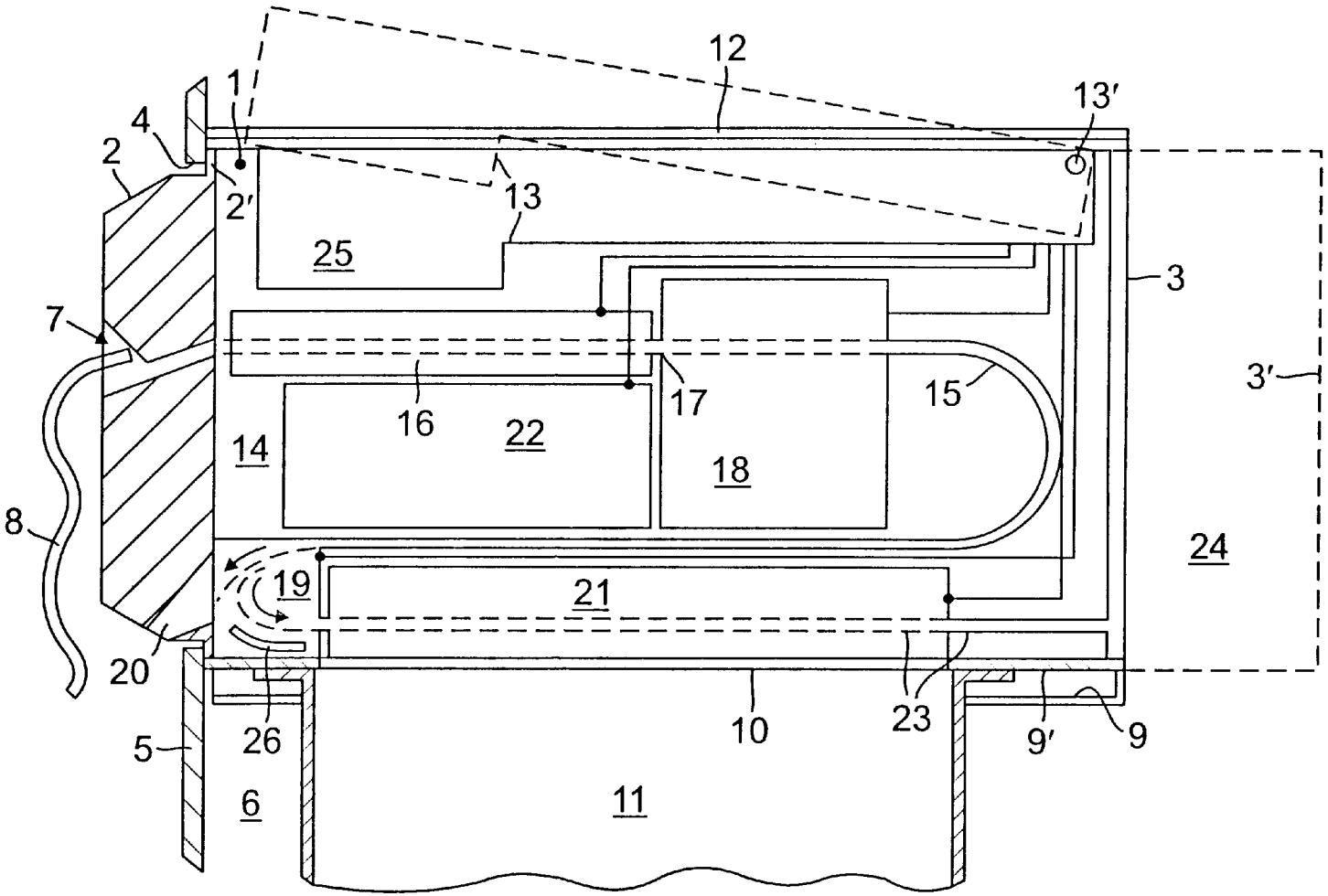
FIG. 1 shows a right-parallelepipedal banknote reader with a money container arranged beneath it.

In FIG. 1, reference numeral 1 denotes one of the two substantially rectangular side plates, arranged parallel to each other and spaced apart by a predetermined distance, of a right-parallelepipedal banknote reader the end-wall part 2 of which is fastened to the one narrow side of the side plates 1 in an easily exchangeable manner. The side plates 1 are defined at the rear narrow side by a border 3 or 3'. In the working position of the banknote reader, the end-wall part 2 projects, for example, out of a vending machine 6 through an opening 4 cut in a wall 5. The end-wall part 2 has at least one receiving opening 7 for banknotes 8. The border of the cut-out opening 4 covers a base part 2' of the end-wall part 2, on which the end-wall part 2 is fastened to the side plates 1. The areas of mutual contact of the border of the cut-out opening 4 and the base part 2' are so selected that they prevent access to the interior of the vending machine 6.

For protection from dust and mechanical damage the banknote reader is inserted into a tubular sleeve 9 of rectangular cross-section which, for example, has been folded from sheet metal and which has, on a first narrow side 9' and arranged between the side plates 1, a connecting opening 10 to a money container 11, which is detachably joined to the sleeve 9, in order to collect the banknotes 8 in the money container 11 after the acceptance decision. The length of the sleeve 9 is such that, from the base part 2' to the border 3 or 3', the banknote reader is located inside the sleeve 9. Below the second narrow side 12, which lies opposite the first narrow side 9, the side plates 1 have a cut-out portion for a flap 13.

The flap 13 is pivotally mounted about an axis in the form of a hinge 13' anchored in the side plates 1. As soon as the banknote reader has been drawn out of the sleeve 9, the flap 13 can be opened and allows free access for maintenance work on the banknote reader in the interior 14 between the side plates 1. By way of example, in the drawing of FIG. 1 the flap 13 has the hinge 13' in the immediate vicinity of the border 3, the broken lines indicating the flap 13 when it is being opened.

The interior 14 of the banknote reader has space for a system 15 for transporting the banknotes 8, which system establishes a transport path along which the banknotes 8 are individually transported through modules of the banknote reader arranged along the transport path. The easily exchangeable modules determine the function of the banknote reader and are assigned to fixed locations along the transport path. For example, belts, not shown here, which are guided over rollers form the transport system 15, the axes of the rollers penetrating the side plates 1 at right angles thereto.

The receiving opening 7 is immediately adjoined downstream by an entry channel 16 which extends as far as the entrance 17 to a checking device 18 for detecting the authenticity of the banknotes 8. The checking device 18 may be adjoined downstream by a routing gate 19 which branches into a return channel 20 through the end wall 2 and into a stacker 21. In the most simple design of the banknote reader, neither a routing gate 19 nor a stacker 21 is installed in the interior 14, the space for the modules 19 and 21 that have not been installed remaining free for any retrofitting. The side plates 1 form, therefore, an installation housing of the banknote reader.

Both the receiving opening 7 and the return channel 20, if present, pass through the end-wall part 2 from the interior 14 to the user at a slight inclination downward so that any water spray cannot penetrate into the interior 14. The receiving opening 7 and the return channel 20 are narrow rectangles in cross-section, oriented perpendicular to the side plates 1 and corresponding in width to the dimensions of the largest denomination of the banknotes 8 to be received. So that the banknote reader can be sold in many countries without being greatly altered, the spacing of the side plates 1 preferably conforms to the dimensions of the largest banknote, the country-specific end-wall part 2 being chosen according to the denominations.

A space located between the entry channel 16 and the transport path leading past the stacker 21 to the end-wall part 2 is occupied by a drive unit 22 which is coupled to the transport system 15.

In order to restrict the length of the banknote reader and make optimum use of the interior 14, the transport path is folded. Downstream of the checking device 18, the transport path bends through 180° towards the first narrow side 9 and towards the end-wall part 2 and leads between the checking device 18 and the space for the stacker 21 to the entrance of the routing gate 19 which is situated immediately behind the return channel 20.

If the routing gate 19 has been installed, the transport path branches at the routing gate 19. The one branch leads to the return channel 20 and the other branch bends by 180° towards the stacker 21 again and towards the first narrow side 9 in the direction of the rear boundary 3. It opens onto a transport belt 23 of the stacker 21. All the mechanical functions of the stacker 21 can be driven, for example, by the common drive unit 22. The transport belt 23 extends parallel to the first narrow side 9 from the routing gate 19 to the rear boundary 3, so that the transport path is folded in a "Z" shape.

According to Research Disclosure, December 1984, RD 24820 mentioned at the beginning, the stacker 21 has a motor-driven ram which transports the banknotes 8 aligned with the connecting opening 10 by the transport belt 23 into the money container 11.

If a temporary cash-box 24 for banknotes 8 has been provided, the side plates 1 have a greater length, the lengthened part with the boundary 3' being shown by a dashed line in the drawing of FIG. 1. It is also possible for the temporary cash-box 24 to be added on, so that the banknote reader has the advantage that it can be retrofitted with the temporary cash-box 24.

The temporary cash-box 24 receives the banknotes 8, inserted individually through the receiving opening 7 by the customer, at the end of the transport belt 23 and places them on a bundle formed by banknotes that have already been inserted. At a command of the control device 25, the temporary cash-box 24 returns the bundle to the transport belt 23 and the bundle as a whole is conveyed in the opposite direction of the transport belt 23 towards the routing gate 19. The bundle can be pushed by the stacker 21 into the money container 11 or can be returned by the transport belt 23 to the customer through the return channel 20 by means of a guide plate 26.

A control device 25 monitors the functions of the banknote reader, evaluates the measurements made by the checking device 18 and, when predetermined sale criteria are satisfied, gives clearance for the service operation of the vending machine 6. The control device 25 is built into the flap 13 and can be pivoted therewith so that both the control device 25 and the entry channel 16 and the checking device 18 are easily accessible from the second narrow side 12 during maintenance work. The installed modules 16, 18, 19, 21, 22 and 24 are connected to the electronic control device 25 by lines which provide for the necessary data exchange or the power supply. The control device 25 recognises which of the modules 16, 18, 19, 21, 22 and 24 are connected to it and is designed to adapt its program for reading banknotes according to the units 16, 18, 19, 21, 22 and 24 that are connected. The banknote reader has the advantage that additional functions that are desired subsequently are performed according to the module additionally installed or modules that have been removed are blocked without its being necessary to replace or re-program the control device 25 itself.

Not shown here are the sensors, such as, for example, light barriers, which are necessary for monitoring the transport of the banknotes 8, and their connections to the control device 25.

A banknote 8 inserted through the receiving opening 7 is exactly aligned in the entry channel 16 with the transport system 15 which takes up the banknote 8 at the entrance 17 to the checking device 18 and transports it further. The entry channel 16 prevents further banknotes 8 from being pushed in before the checking device 18 is free for the next banknote 8.

The checking device 18 scans characteristic features of the banknote 8 by an optical and/or magnetic process. The measurements transmitted to the control device 25 or characteristic values derived therefrom are compared with stored set values. When there is agreement, the control device 25 judges the banknote 8 to be acceptable and it can be deposited, for example, in the temporary store 24 until the customer decides whether he wants the service or not. In the former case, the temporary store 24 conveys the banknotes 8 into the stacker 21 which conveys them into the money container by means of the motor-driven ram. If the user stops inserting the notes, the temporary store 24 gives up the banknotes 8 that have already been inserted to the transport belt 23 which conveys the banknotes 8 through the space of the stacker 21 and returns them via the guide plate 26 in the routing gate 19 to the customer through the return channel 20.

Figure 2:
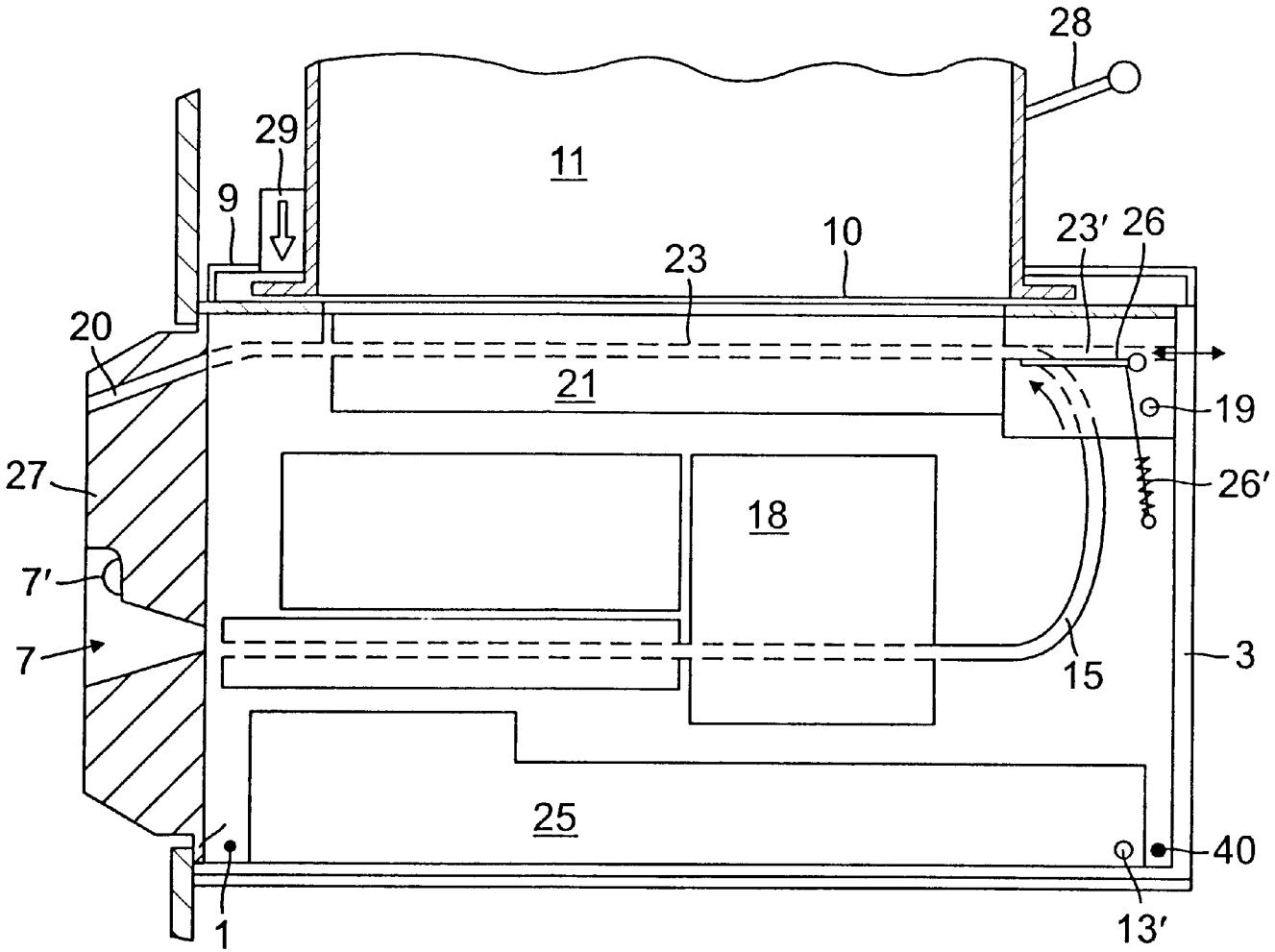
FIG. 2 shows the banknote reader with the money container arranged above the housing, FIGS. 3*a* and *b* show an installation unit for maintenance work from the front, FIGS. 4*a* and *b* show the installation unit for maintenance work from the rear.

In FIG. 2, the banknote reader has been turned about its longitudinal axis by 180° in the cut-out opening 4, with the result that the money container 11 is situated above the side plates 1 and, advantageously, new installation possibilities are made available. In this design the stacker 21 is necessary to push the banknotes 8 (FIG. 1) upward into the money container 11. The only adaptation of the banknote reader for installation in this position is the replacement of the end-wall part 2 (FIG. 1) by the front part 27 in which the receiving opening 7 and the return channel 20 are arranged differently for more convenient insertion of the banknotes 8, with the receiving opening 7, viewed from the customer, being arranged below the return channel 20. In the case of the front part 27 also, the receiving opening 7 and the return channel 20 are likewise inclined slightly downward towards the customer.

The end-wall parts 2 and the front parts 27 may be formed entirely from glass-fibre-reinforced plastics material. This technique makes it possible to manufacture good ergonomic shapes of the receiving opening 7 and the return channel 20 at low cost. Arranged in the region of the receiving opening 7 is a signal display 7' which can be connected to the control device 25 by a plug connection and which, for example, asks the user to insert further banknotes 8.

In the drawing of FIG. 2, the transport path formed by the transport system 15 is shown by way of example as a "U" shape. Downstream of the checking device 18, the transport path bends through 180° directly to the stacker 21 and passes the banknote 8 directly to the transport belt 23. The shorter transport path has the advantage that the banknote 8 reaches the stacker 21 faster.

If a temporary cash-box 24 (FIG. 1) is present, the transport system 15 includes the routing gate 19 arranged downstream of the checking device 18 at the stacker entrance, one branch of which directs the transport path to the trunk section of the routing gate in order to lead into that trunk section after a turn of 180°. The trunk section of the routing gate 19 is formed by the transport belt 23. The routing gate 19 has a pivotally arranged guide plate 26 which is held in the rest position by a spring 26', it being possible to steer the banknotes 8 from the trunk section of the routing gate 19 into a branch 23' of the transport belt 23, for example to the temporary cash-box 24 (FIG. 1), since the branch to the transport path is covered. A banknote 8 fed from the transport path pivots the guide plate 26, against the force of the spring 26', in front of the branch 23' and is diverted by the guide plate 26 to the transport belt 23 and conveyed into the stacker 21. The passive control of the routing gate 19 has the advantage of simplicity and relieving the burden on the power supply and on the control device 25 (FIG. 1), since the transport path in the routing gate 19 is determined merely by reversing the drive unit 22 (FIG. 1), that is to say by changing the direction of transport.

The banknote reader has the advantage that, after simply replacing the end-wall part 2 by the front part 27, the range of application of the banknote reader is extended and that both simple and convenient designs can be made with the same modules, and the simple designs can be retrofitted on site at any time even under difficult conditions.

The modules having the same functions can have different designs, but must meet the requirement with regard to the amount of space occupied and with regard to the transport path of the banknotes 8. There may be mentioned as an example at this point the checking device 18 which, depending on its design, scans the features of the banknote 8 optically and/or magnetically.

The money container 11 has a lever 28 which acts on a slide for opening and closing its entry opening. A mechanical feeler 29 advantageously arranged on the money container 11 is designed to sense the position of the money container 11 relative to the sleeve 9 and the connecting opening 10. The feeler 29 prevents opening of the money container 11 as long as the feeler 29 has not been locked into the sleeve 9 in a predetermined manner. Conversely, the money container 11 cannot be removed from the sleeve 9 if the connecting opening 10 is still open and the feeler 29 is locked in. This increases security against wrongful manipulation by unauthorised persons.

The most simple design of the banknote reader, which is described above and does not have a routing gate 19, a stacker 21 or a temporary cash-box 24, has a transport path as shown in FIG. 2 and can be used only in the installation position shown in FIG. 1. The banknotes 8 accepted by the control device 25 are conveyed by the transport system 15 to above the connecting opening 10 and fall loosely into the money container 11, which may be an open receptacle, for example a simple sack. Banknotes 8 that are not accepted are returned by the transport system 15.

If the end-wall part 2 or the front part 27 does not have a return channel 20, the banknote 8 is returned to the user by the transport system 15 through the receiving opening 7, by reversing the transport direction, as soon as the control device 25 has decided to return it. The control device 25 is advantageously designed to recognise a coding in connection with the plug contact of the signal display 7', for example by means of a short-circuit bridge in the plug part. The control device 25 reads the plug coding and gathers information on the presence of the return channel 20 so that the program of the control device 25 is adapted to the design of the banknote reader.

If the banknotes 8 to be accepted have no differences or only slight differences in their width, a symmetrical design of the money container 11 and of the banknote reader with an end-wall part 2 or front part 27 is sufficient to combine all of the designs shown in FIGS. 3 and 4, thus providing advantages in parts management for manufacture and service.

So that banknotes 8 of different widths also can be recognised reliably, the banknotes 8 must be aligned in the checking device 18 to be read and recognised. For that purpose, the banknote 8 is to be inserted into the receiving opening 7 with the left side flush since this orientation is the easiest for the customer. This, however, necessitates an asymmetrical arrangement of the modules in the installation housing of the banknote reader and of the entry opening of the money container 11 so that even narrow banknotes 8 can be stacked reliably. The asymmetrical arrangement necessitates an arrangement of the modules that is displaceable perpendicular to the side plates 1 in order to ensure that the banknotes 8 can be inserted flush-left in all installation positions of the banknote reader. The specified position of the banknote 8 can be monitored in the receiving opening 7 of the end-wall part 2 or front part 27. The locking arrangement of the feeler 29 is to be matched to one of the two permissible designs A and B of the money container 11.

Figure 3A:
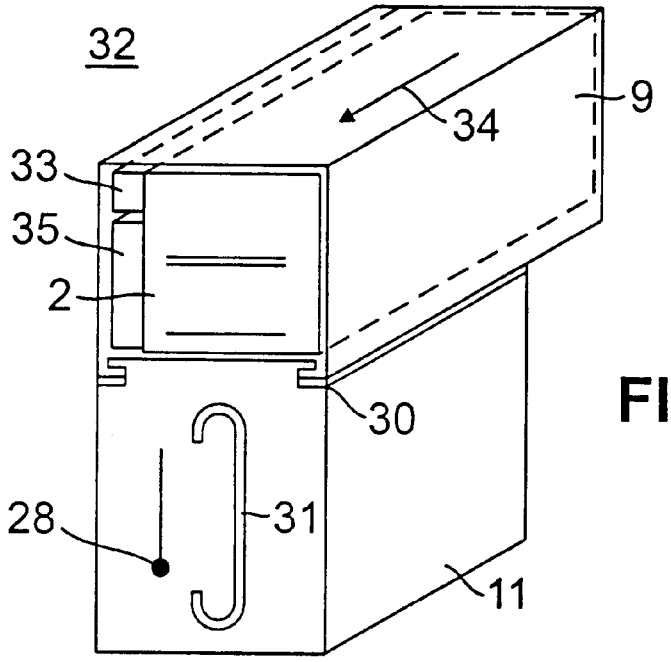
Figure 3B:
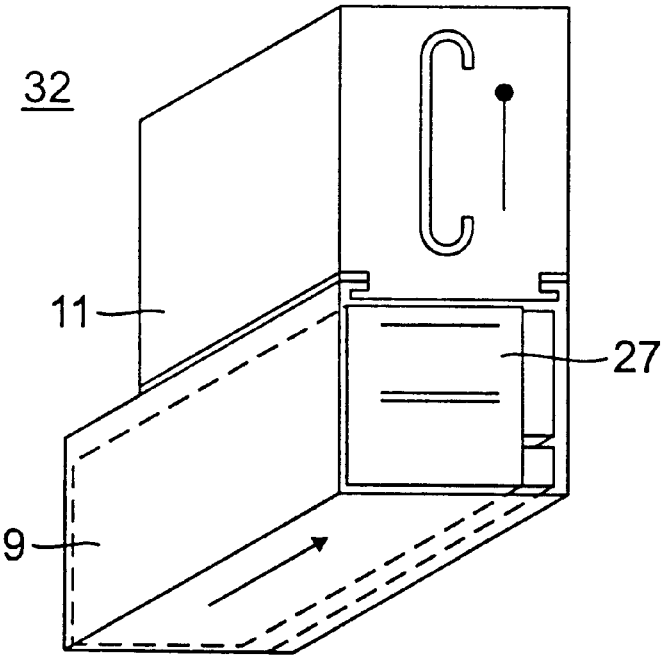
Figure 4A:
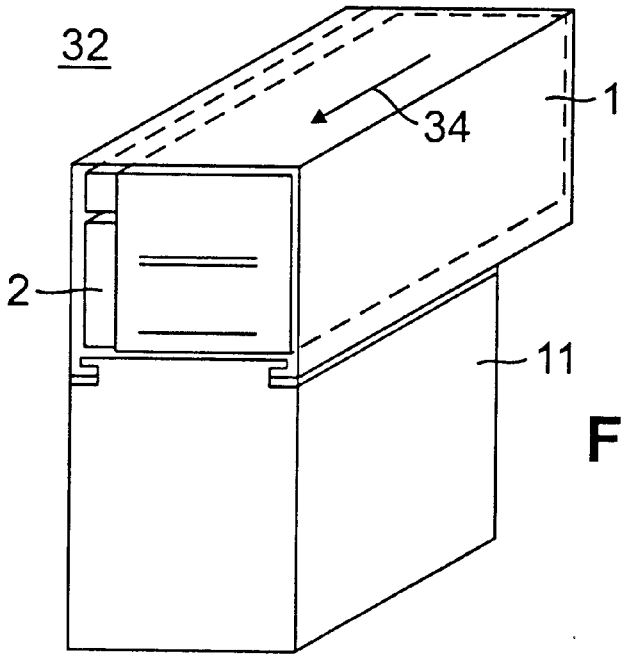
Figure 4B:
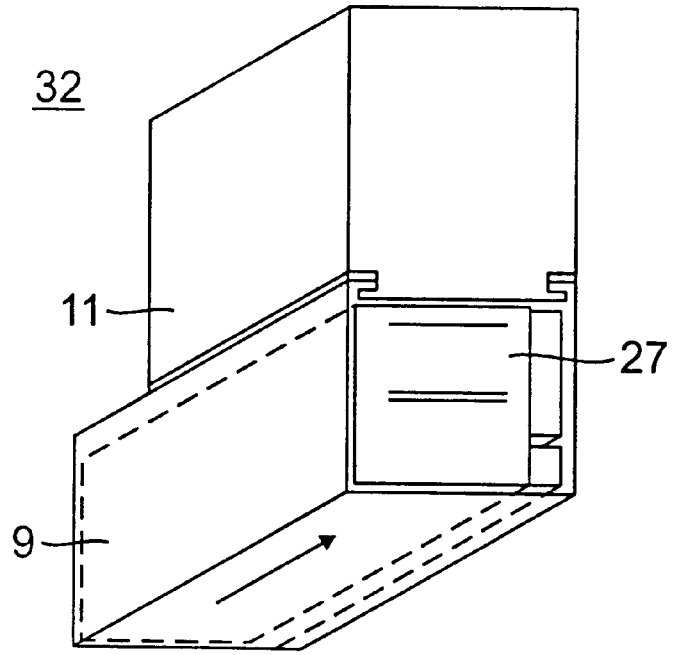

FIGS. 3 and 4 show four possible combinations of the arrangement of the banknote reader and the money container 11, which can be used for installation in the vending machine 6 (FIG. 1). The money container 11A is intended for the arrangement shown in FIGS. 3*a* and 4*b* whereas, in FIGS. 3*b* and 4*a*, the money container 11B, which is constructed as a mirror image of design A, is suitable.

These four arrangements have the advantage that a single banknote reader having an end-wall part 2 or a front part 27 and two money containers 11 of the A and the B design suffice to fulfill all known installation conditions.

In FIG. 3*a*, the money container 11A is arranged below the sleeve 9. The banknote reader is equipped with the end-wall part 2. The money container 11A is in the form of an exchangeable parallelepipedal cassette, the entry opening of which is aligned with the connecting opening 10 (FIG. 1) and can be closed by means of closure plates upon operating the lever 28. Parallel to the longitudinal edges, the money container 11 has a groove 30 on each side face, for example near the connecting opening 10. The sleeve 9 is lengthened on both sides in the direction towards the money container 11 by profiles so that, when the money container 11 is pushed in, the two grooves 30 are engaged by the profiles. The banknote reader and the money container 11 together form an installation unit 32. A solid design of the money container 11 is disclosed in Swiss Patent Specification No. 658 736 mentioned at the beginning.

At its front end, the money container 11 has a handle 31 and the lever 28. Using the handle 31, the money container 11, which slides with the grooves 30 in the profiles of the sleeve 9, can be pushed in smoothly until the feeler 29 (FIG. 2) locks into the predetermined position of the money container 11 and releases the lever 28 for opening the entry opening of the money container 11 so that the installation unit 32 is ready for operation.

If the money container 11 filled with the banknotes 8 (FIG. 1) is to be transported to a vending machine centre, first the entry opening of the money container 11 is to be closed by the lever 28, thus releasing the money container 11 for withdrawal. The closed money container 11 can then be withdrawn from the sleeve 9 by the handle 31. The lever 28 is mentioned merely by way of example, since the closing of the entry opening and the locking between the money container 11 and the banknote reader in the predetermined position can also be effected with a twist closure, such as, for example, a twist lock and key.

For easy maintenance, the banknote reader is advantageously arranged inside the sleeve 9 on at least one telescopic rail 33. The telescopic rails 33 are fitted to the side plates 1 (FIG. 1) in such a manner that, although the flap 13 (FIG. 1) is covered at the side, outside the sleeve 9 it can be pivoted unhindered. The banknote reader, therefore, can easily be withdrawn from the sleeve 9 for maintenance in the direction of an arrow 34, with the end-wall part 2 foremost, when the wall 5 (FIG. 1) of the vending machine 6 has been removed. In its predetermined working position, the banknote reader can be locked by a second twist lock and key. Below the telescopic rail 33, there is still a space 35 available on the side plate 1 for further electronic circuits, mechanical transmission means or a power supply of the banknote reader. Since the modules of the banknote reader are arranged between the side plates 1 and the flap 13 (FIG. 1) can easily be pivoted, the maintenance operations, such as cleaning, removal of blockages after attempted frauds, maintenance of the transport system 15 (FIG. 1) and so on, can be carried out quickly and virtually without any effort on dismantling.

For reasons of space it may be necessary to arrange the installation unit 32 according to FIG. 3*b*. The installation unit 32 has been turned through 180° about an axis perpendicular to the end face 2 as compared with the arrangement in FIG. 3*a*, and the end-wall part 2 (FIG. 3*a*) has been replaced by the ergonomically more advantageous front part 27; this necessitates the use of the money container of design 11B.

Figure 5:
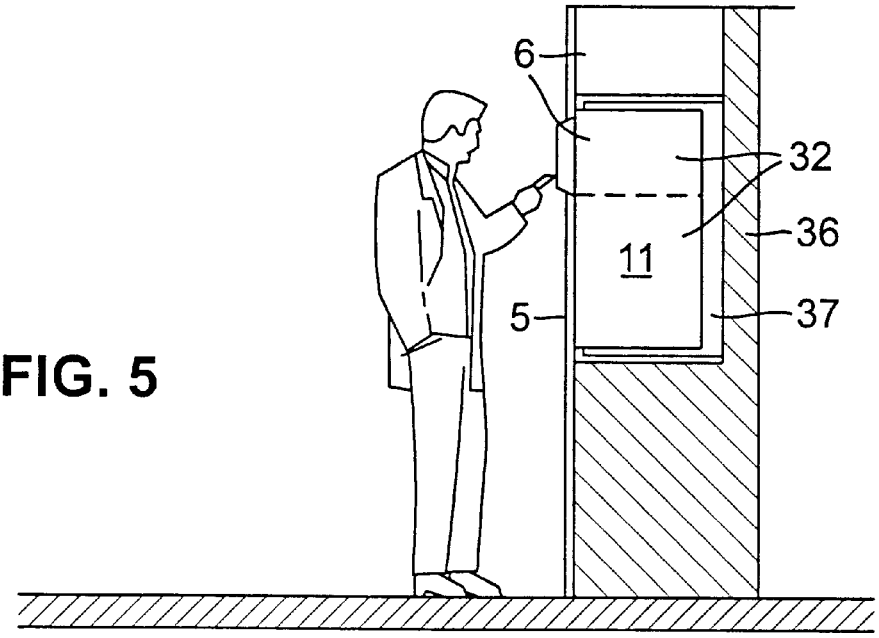
FIG. 5 shows a vending machine, FIGS. 6*a* and *b* show the vending machine with a security room for maintenance.

FIG. 5 shows the vending machine 6 with the installation unit 32 arranged in the operating position, for example built into a wall 36 of a building in a niche 37. As soon as the wall 5 facing the public has been removed, the banknote reader can be withdrawn from the sleeve 9 and from the niche 37 for maintenance or the money container 11 can be exchanged.

In FIGS. 4*a* and 4*b*, the money container 11B and 11A, respectively, and the banknote reader are of opposite orientation to each other in the installation unit 32, that is to say the lever 28 (FIG. 3*a*) and the end-wall part 2 or front part 27 are arranged on the two mutually opposing sides of the installation unit 32. The money container of design 11B and 11A, respectively, can be manipulated from the side of the installation unit 32 remote from the wall 5 (FIG. 1) and the banknote reader can be withdrawn from the sleeve 9 counter to the direction of the arrow 34. In the drawings of FIGS. 4*a* and *b*, the handle 31 (FIG. 3*a*) and the lever 28 (FIG. 3*a*) are not visible since they are arranged on the side of the installation unit 32 remote from the end-wall part 2 or front wall part 27.

Figure 6A:
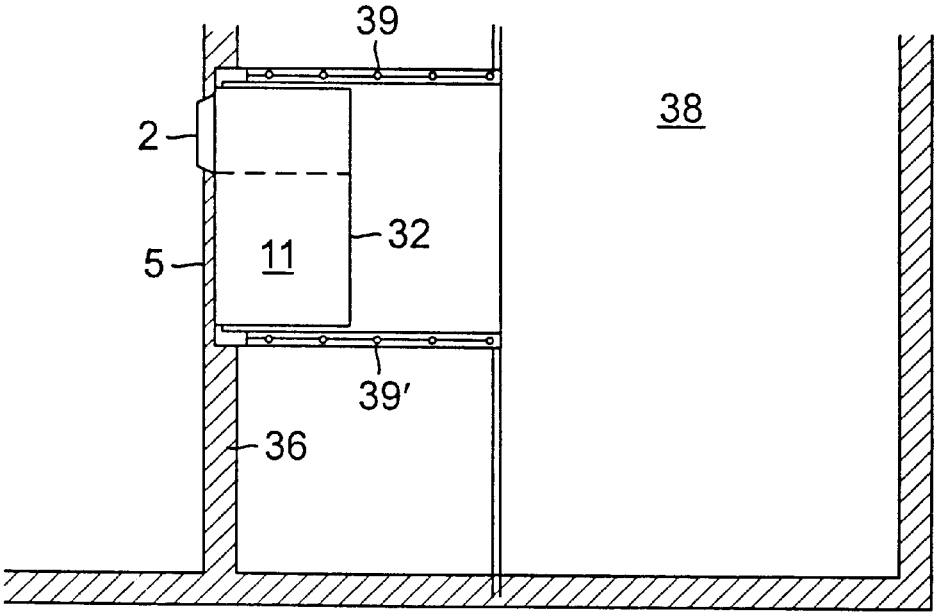
Figure 6B:
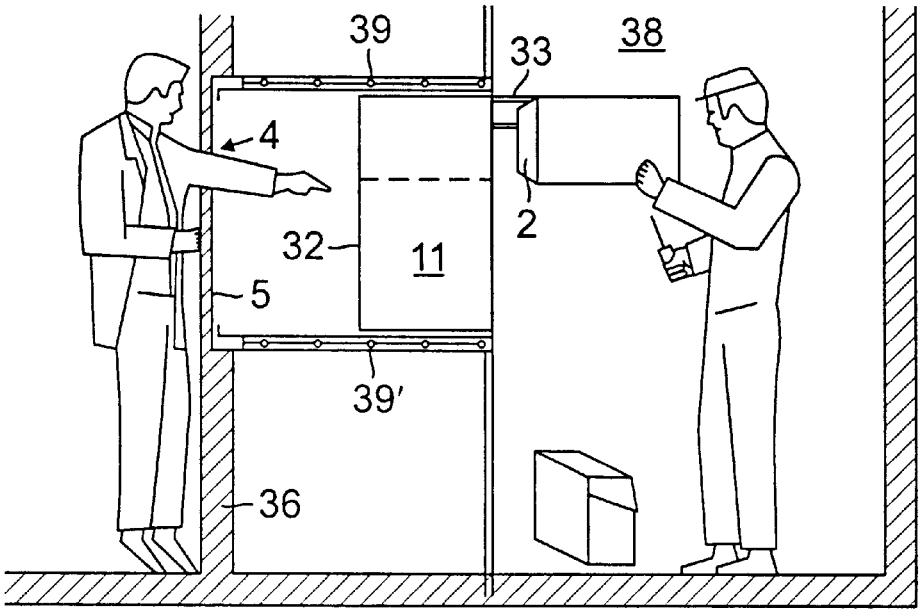

FIGS. 6*a* and 6*b* show the installation of the banknote reader in a security room 38, the end-wall part 2 or front part 27 forming the receiving/returning part (FIG. 4*b*) and the wall 5 together with the wall 36 of the building dividing the security room 38 from the public. In the protection of the security room 38, it is possible both to exchange the money container 11 and to carry out the necessary maintenance work. The installation unit 32 is advantageously arranged on roller bearings 39, 39' so that the installation unit 32 can be moved into the security room 38 for maintenance without the additional assistance of an installation engineer.

In FIG. 6*b*, the installation unit 32 can be drawn sufficiently far into the security room 38 that the money container 11 can no longer be reached through the cut-out opening 4; this prevents an unauthorised person from tampering with the money container 11 through the cut-out opening 4. When the maintenance work has been completed, the installation unit 32 can be pushed towards the wall 5 again with little effort (FIG. 6*a*).

Figure 7:
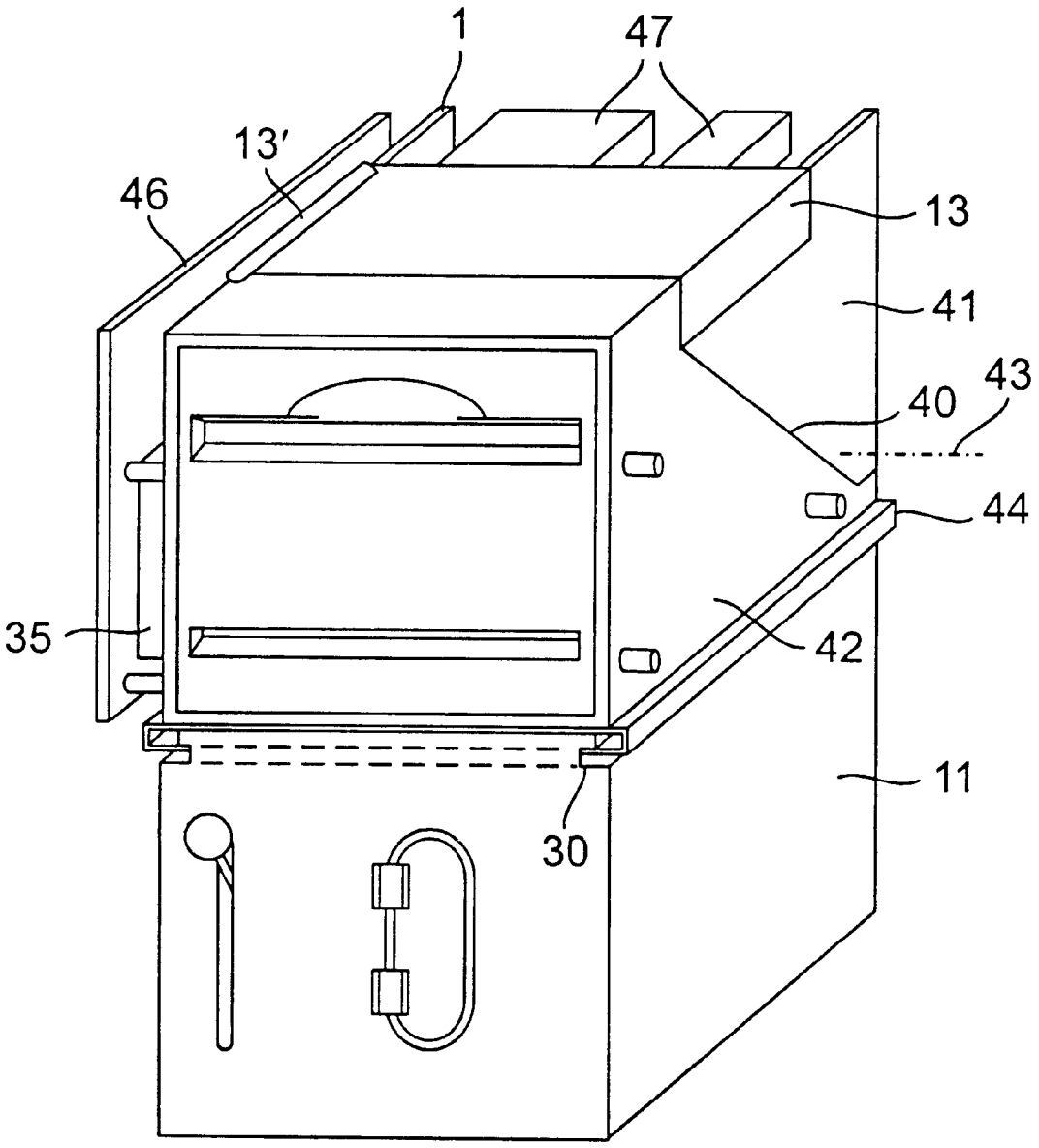
FIG. 7 shows the installation unit with a mounting plate.

The "U"-shaped transport path (FIG. 2) has, as a further advantage, easier accessibility. The installation unit in the arrangement according to FIG. 3*a* is shown by way of example in FIG. 7, the two side plates 1 of the installation housing being divided along a substantially diagonal dividing line 40 into an upper part 41 and a lower part 42. The two parts of the installation housing are articulated to each other by means of a common axis 43 at the level of the return channel 20 at the side remote from the end-wall part 2 or front part 27 (FIG. 2). The end-wall part 2 or front part 27 is arranged on the lower part 42 which is equipped with a "U"-shaped intermediate piece 44 for connection to the money container 11. The "U"-shaped intermediate piece 44 is engaged by the grooves 30 of the money container. Advantageously, the two side plates 1 of the lower part 42 may each have three pins 45 in identical arrangement, with which the banknote reader is arranged on a mounting plate 46 in any installation position, the space 35 between the side plate 1 and the mounting plate 46 remaining free. In operation, the upper part 41 and the lower part 42 are locked to each other. The mounting plate 46 can be joined to the vending machine directly or by means of the telescopic rail 33 (FIG. 6*b*).

The top 1 (FIG. 1) may, for example, also be omitted. The flap 13 together with the control device 25 (FIG. 1) is advantageously joined by the hinge 13' to the upper edge of the one side plate 1 of the upper part 41 so that plugs 47 for the signalling and supply lines can be led away to the rear and the flap remains easily pivotable about the hinge 13' without disconnecting those lines. Opening of the upper part 41 and/or pivoting of the flap 1 is possible, therefore, also in the installed position. When the installation housing is hinged open, the transport path in the region of the entry channel 16 (FIG. 1) and of the checking device 18 (FIG. 1) can be fully exposed in order, above all, to maintain or adjust sensors of the checking device 18.

Figure 8:
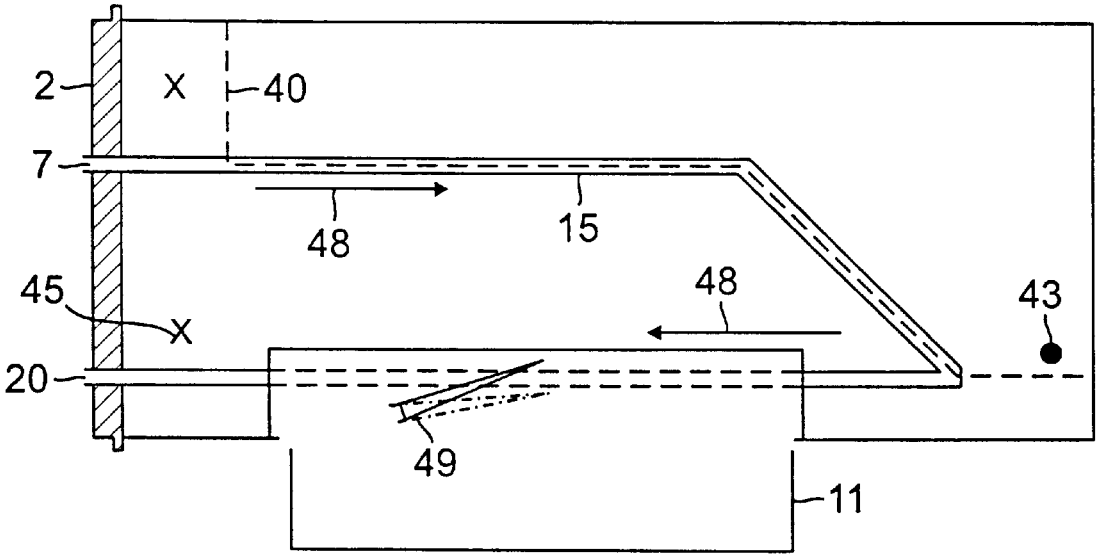
FIG. 8 shows the banknote reader with a diverter.

The banknotes 8 (FIG. 1) are in FIG. 8 passed into the "U"-shaped transport path, shown schematically, through the receiving opening 7 in the end-wall part 2, the banknote 8 being transported in the direction of the arrows 48. In the most simple design of the banknote reader, a diverter 49, which like the routing gate 19 (FIG. 1) is controlled by the checking device 18 (FIG. 1), is arranged in place of the stacker 21 (FIG. 2). The diverter 49 can be swivelled into the transport path so that the banknote 8 to be paid in (FIG. 1) is diverted from the transport path and into the money container 11 and falls into the money container 11. If the banknote 8 is not to be accepted, the diverter 49 is swivelled out of the transport path so that the banknote 8 is returned via the return channel 20. For maintenance, the banknote reader can be opened about a hinge, along the dashed dividing line 40. The intermediate piece 44 (FIG. 7) is omitted if a light open container is used for the banknotes instead of the heavy money container 11. In that case the banknote reader is light enough to be fastened directly to the wall 5 (FIG. 1) in the cut-out opening 4, the two pins 45 arranged at the end-wall part 2, which are shown by crosses in the drawing of FIG. 8, being joined to the wall 5 by means of angle irons.

We claim:

1. A banknote validator for co-operating with a removable money container, the validator comprising:

a housing having a front and a rear;

a banknote aperture disposed at the front of the housing for receiving banknotes;

a coupling member for slidably receiving a removable money container to enable the money container to be removably fitted in a money container position by sliding along a sliding axis in either a forward or rearward direction, the sliding axis being parallel with a front-rear direction of the housing;

at least one sensor in the housing for sensing a banknote for determining its acceptability;

a transfer device in the housing operable to transfer banknotes to the money container, the transfer device being disposed on an opposite side of the coupling member to the money container position so as not to block the sliding axis; and a temporary storage device in the housing for temporarily storing banknotes, the temporary storage device being located on the same side of the coupling member as the transfer device so as not to block the sliding axis, and being located towards the rear of the housing, rearwards of the transfer device.

2. A banknote validator according to claim 1, wherein the housing comprises two housing parts, and each of the two side plates of the housing are divided into two parts along a substantially diagonal dividing line of the housing, the two housing parts being pivotally coupled relative to each other about an axis, such that the housing can be opened by pivoting one of the housing parts about the axis to expose the temporary storage device.

3. A banknote validator for co-operating with a removable money container, the validator comprising:

a housing comprising two side plates;

a banknote aperture disposed in the housing for receiving banknotes;

a banknote transport path disposed in the housing;

at least one sensor in the housing for sensing a banknote for determining its acceptability;

a temporary storage device in the housing for temporarily storing banknotes;

a coupling member for slidably receiving a removable money container to enable the money container to be removably fitted in a money container position by sliding along a sliding axis in either a forward or rearward direction, the sliding axis being parallel with a front-rear direction of the housing;

a transfer device in the housing operable to transfer banknotes to the money container;

the housing further comprising two housing parts, and each of the two side plates of the housing are divided into two parts along a substantially diagonal dividing line of the housing, the two housing parts being pivotally coupled relative to each other about an axis, such that the housing can be opened by pivoting one of the housing parts about the axis to expose the banknote transport path.

* * * * *